United States Patent [19]

Conover, deceased

[11] 3,941,190

[45] Mar. 2, 1976

[54] WELL CONTROL APPARATUS

[75] Inventor: George E. Conover, deceased, late of Houston, Tex., by Charlotte Conover, executrix

[73] Assignee: Lynes, Inc., Houston, Tex.

[22] Filed: Nov. 18, 1974

[21] Appl. No.: 524,760

[52] U.S. Cl. ..... 166/187; 166/188; 166/224 A; 175/230; 175/317; 277/34.6

[51] Int. Cl.[2] ..... E21B 33/127

[58] Field of Search ..... 166/187, 188, 120, 123; 175/317, 230

[56] References Cited

UNITED STATES PATENTS

| | | | |
|---|---|---|---|
| 2,994,378 | 8/1961 | Reistle, Jr. | 166/187 |
| 3,529,665 | 9/1970 | Malone | 166/187 |
| 3,606,924 | 9/1971 | Malone | 166/187 |

*Primary Examiner*—Ernest R. Purser
*Attorney, Agent, or Firm*—Jack W. Hayden

[57] ABSTRACT

A tool for running on a well string such as a drill string in a well bore carries inflatable packer means to close off the well bore adjacent the tool. The tool includes a body having a longitudinal bore therethrough with seating means and shock absorbing means for absorbing the shock of seating a bore close off means to close off the bore in the drill string. The bore close off means includes latch means for latching the bore close off means in seated position in the well string.

The tool may be positioned in the drill string near the drilling bit and when pressure is applied in the well string at the earth's surface such pressure is conducted through the bore close off means to inflate the inflatable packer means and seal off the well bore beneath the inflated packer means.

The bore close off means includes valve means for selectively controlling flow through the bore close off means, or for preventing flow through the bore close off means, as well as shiftable valve means which enables well bore pressure to be equalized above and below the packer means during deflation of the inflatable packer means.

The tool also includes port means normally closed off by shiftable valve means which may open for circulating fluid in the well bore above the inflated packer means when desired.

The tool also includes valve means responsive to the pressure differential between the drill string and the well bore above the inflatable packer means to sequentially inflate the inflatable packer means when the bore close off means is seated in the well string and to sequentially equalize the pressure above and below the packer means and deflate the packer means.

31 Claims, 10 Drawing Figures

WELL CONTROL APPARATUS

CROSS REFERENCE TO RELATED APPLICATION

The present application relates to my copending application Ser. No. 261,611, filed June 14, 1972 for "Tool For Running On A Drill String In A Well Bore", which is assigned to the assignee of this application now U.S. Pat. No. 3,850,240.

DESCRIPTION OF THE PRIOR ART

In applicant's opinion, some of the closest references appear to be Hyde, U.S. Pat. No. 3,111,169; Cochrum et al., U.S. Pat. No. 3,503;445; Warrington, U.S. Pat. No. 3,332,215; Hughes, U.S. Pat. No. 2,862,562; Malone, U.S. Pat. No. 3,529,665; Boynton, U.S. Pat. No. 2,301,190; and Williams et al., U.S. Pat. No. 2,338,369.

Such prior art does not appear to include valve means which sequentially functions responsive to the pressure differential between the drill string and the well bore above the inflatable packer means, and to cause deflation of the inflatable packer means under substantially all well bore conditions.

While various devices for closing off the well bore and the drill string of a well bore surrounding the drill string while the drill string remains within the well bore have been provided, the construction and function of such prior art devices is such that it is difficult to selectively sequentially control the operation of the tool in a desired manner. Additionally, such prior art constructions do not appear to provide positive means which assure that the inflatable element carried by the tool in the well string is deflated after the tool has been operated and while the drill string is in the well bore so that normal drilling operations may be continued without possible damage to the inflatable element carried on the well string.

Other prior art devices do not provide an arrangement for equalization of the pressure above and below the inflatable element with the interior of the inflatable element, while the inflatable element is being deflated, or while drilling operations are being continued to aid in inhibiting damage to such inflatable element.

SUMMARY OF THE INVENTION

An object of the present invention is to provide an arrangement which may be utilized as a pack off tool for closing off the well bore annulus and the annulus of a well string such as a drill string while the well string remains in the well bore with a minimum number of moving parts and performing such functions in a desired sequential manner.

Still another object of the present invention is to provide a pack off tool for the well bore and drill string annulus while the drill string remains in the well bore and port means which may be selectively opened above the inflatable packer means for circulation in the well bore above the inflatable packer means.

Yet a further object of the present invention is to provide a well tool for packing off the well bore annulus and the drill string annulus to control a well while the drill string remains in the well bore, and which can be manipulated with a minimum of effort to accomplish such function and to thereafter open the annulus and the drill string for normal well operations.

Yet a further object of the present invention is to provide a closure arrangement for the well bore annulus and a well string in the well bore while the well string remains in the well bore and to accomplish such function in a sequential manner.

Yet a further object of the present invention is to provide a well bore closure arrangement for closing the annulus of a well bore with a well string therein and for closing the well string annulus while the well string remains in the well bore, and to selectively open the well string above the sealed off well bore for circulation of well fluids, or to open the well string below the sealed off well bore annulus for circulation in a desired and selected manner.

Yet a further object of the present invention is to provide a well bore closure arrangement for closing the annulus of a well bore with a well string therein and for closing the well string annulus while the well string remains in the well bore, and to selectively open the well string above the sealed off well bore for circulation of well fluids, or to open the well string below the sealed off well bore annulus and thereafter opening the well bore annulus and the well string annulus in a sequential manner to continue well operations without removing the well string from the well bore.

Still another object of the present invention is to provide a closure arrangement for closing off the well bore annulus in which a well string is positioned and for closing off the well string annulus in a sequential and selected manner and means for equalizing the well bore pressure above and below the closure as such closure is opened.

Yet a further object of the present invention is to provide a well bore closure including an inflatable element carried on a well tool in a well string, closure means with releasable latch means for seating and latching in the well string for closing off the well string, valve means responsive to the pressure in the well string above the bore close off means with reference to the pressure in the well bore above said inflatable packer means for sequential inflation of said packer to close off the well bore and for sequential deflation of said packer to open the well bore around the packer, and additional valve means on the tool and closure for selectively opening the well string through the closure means to circulate or communicate below the inflatable packer means, and to circulate between the well string and well bore above the inflatable closure means.

Yet a further object of the present invention is to provide a well bore closure including an inflatable element carried on a well tool in a well string and closure means for seating in the well string for closing off the well string with valve means responsive to the pressure in the well string above the bore close off means with reference to the pressure in the well bore above said inflatable packer means for inflation of said packer to close off the well bore and for deflation of said packer to open the well bore around the packer and latch means for latching said bore close off means in seated position in the well string.

Other objects and advantages of the present invention will become apparent from a consideration of the following description and drawings.

DESCRIPTION OF THE PREFERRED EMBODIMENTS

Figure 2:
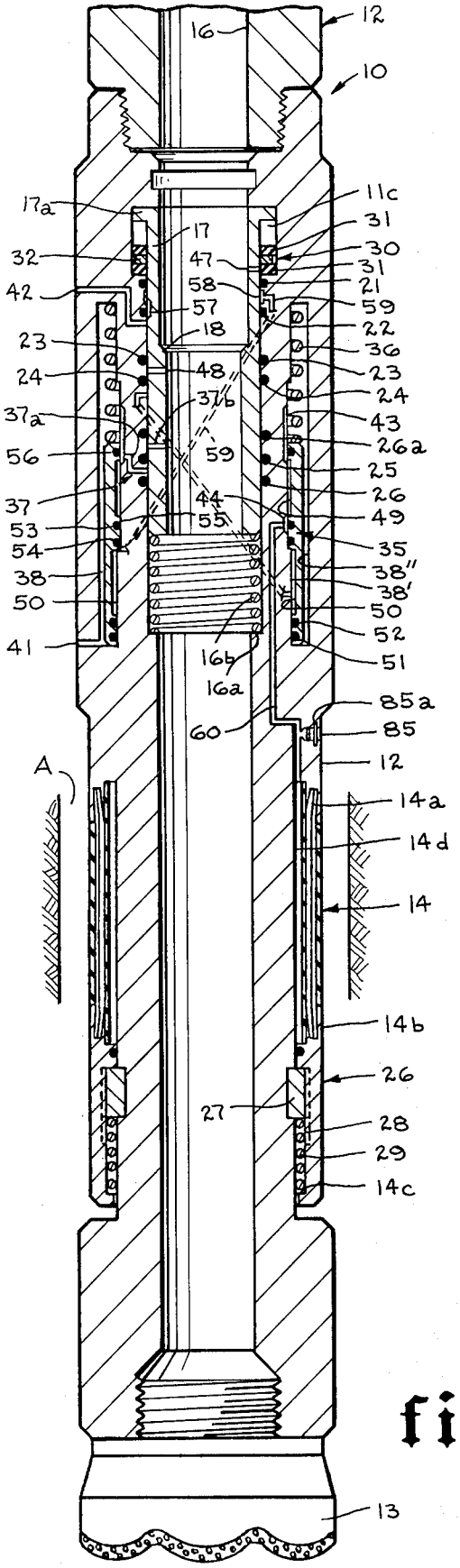
FIG. 2 is a vertical sectional view illustrating a portion of the invention which is adapted to be positioned in a well string such as a drill string and illustrates a body with a reinforced inflatable element thereon, a seating sleeve means within the bore of the body including a shock absorbing means, a control valve, fluid passage means for communicating the well bore with the interior of the inflatable element and with the well bore thereabove and therebelow as well as other fluid passage means in the tool.
Figure 1:
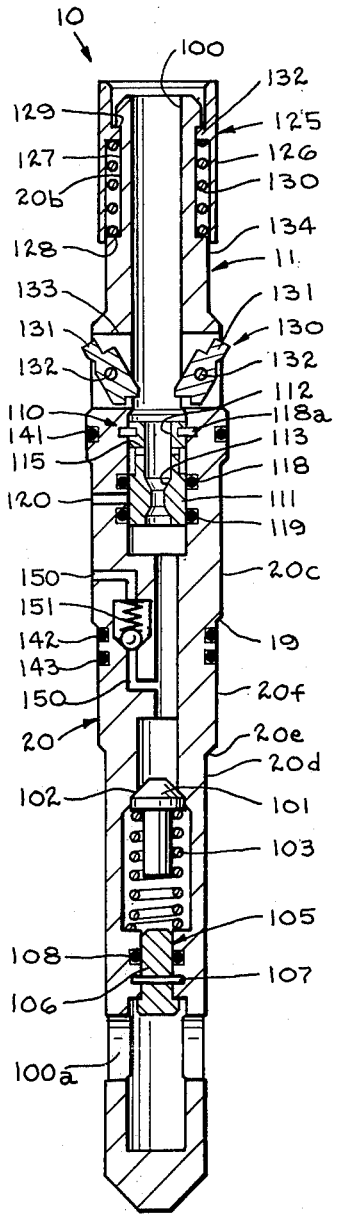
FIG. 1 is a vertical sectional view illustrating a preferred embodiment of a bore close off means forming part of the present invention.
Figure 3:
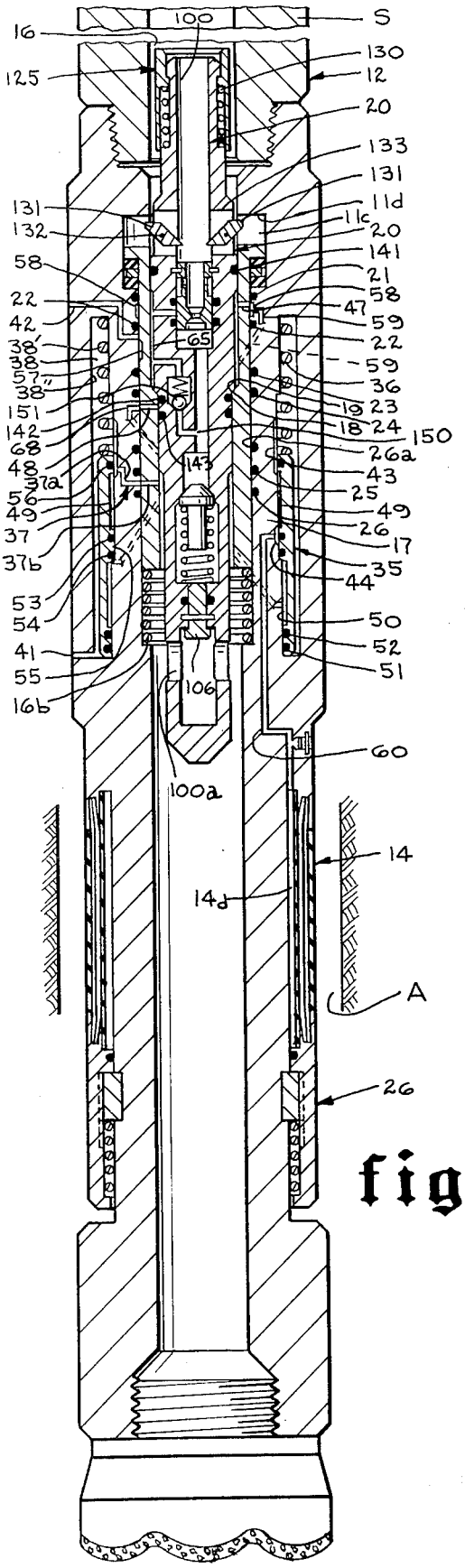
FIG. 3 is a sectional view similar to FIG. 1 but illustrates the bore close off means of FIG. 1 seated on the seating sleeve means and latched in the well string for communicating well string pressure to the control valve for operation of the tool in a desired sequential manner.
Figure 4:
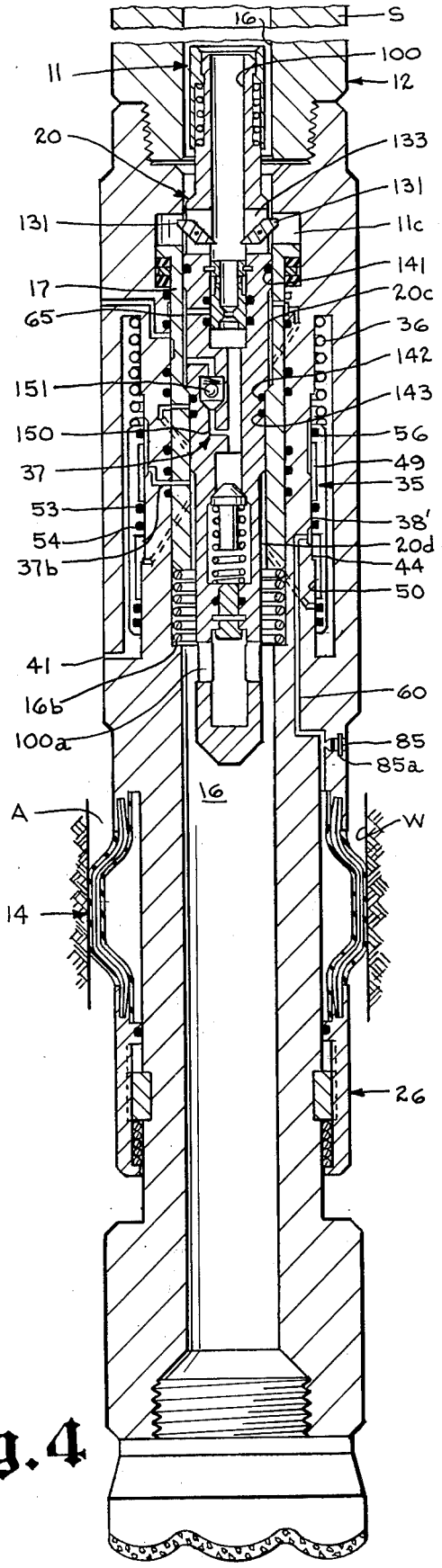
FIG. 4 is a sectional view similar to FIG. 3 and illustrates the position of the control valve after it has moved to close communication between the well bore and inflatable element and open the well string bore to the inflatable element for inflation thereof to close off the well bore annulus.

In FIGS. 1 and 2 the invention is referred to generally by the numeral 10 and includes the bore close off means referred to generally at 11 and a body referred to generally at 12 adapted for securing by ay suitable means in a well string designated S in FIGS. 3 and 4. The well string S may be a drill string or any other type of well string and ordinarily extends upwardly to the earth's surface. As illustrated in FIG. 2 of the drawings, the body 12 is shown as being positioned adjacent the drill bit 13 of a well string; however, it can be appreciated that the present invention may be employed at any desired elevation in any suitable type of a well string and the drill string is by way of example only. The body 12 includes a bore 16 which extends longitudinally thereof and in which is received sleeve valve means 17. The valve means 17 includes a suitable seat arrangement 18 for receiving the enlargement 19 on the body 20 of the bore close off means 11 as more clearly illustrated in FIG. 3 of the drawings.

The bore 16 is provided with suitable shoulder means as illustrated at 16*a* for receiving resilient means in the form of a spring 16*b* therein to support the sleeve valve 17.

Suitable seal means as illustrated at 21, 22, 23, 24, 25, 26 and 26*a* are provided at spaced intervals between the body 12 and seating valve means 17 to seal off therebetween and to assist in controlling communication of various passages in the tool as will be described. It can be appreciated that the construction and arrangement of the valve means 17 enables it to retain the position illustrated in FIG. 2 of the drawings during normal drilling operations when the present invention is employed in a drill string. Also, it will be noted that the reinforced inflatable packer means referred to generally at 14 is secured at its upper end 14*a* to the body 12 and is provided with means represented generally at 26 at its lower end 14*b* to enable the lower end of the reinforced inflatable element 14 to move longitudinally relative to body 12 while inhibiting relative rotation therebetween.

The means 26 includes a key 27 carried by the body 12 longitudinally slidably fitting within the spline 28 formed in the lower end 14*b* of the reinforced element 14. This arrangement accommodates relative longitudinal movement of the lower end of the annular end 14*b* of the inflatable element 14 during inflation and deflation thereof while preventing relative rotation between the body 12 and inflatable element 14 while the drill string is rotating during drilling operations. To aid in retaining the inflatable element in a noninflated position during normal drilling operations and to assist deflation of the inflatable element when the internal pressure is released, the lower end of 14*b* includes spring means 29 which abuts one end of the key 27 and the shoulder 14*c* formed on the lowermost end of the lower end 14*b* which tends to extend or retain the element 14 in deflated position and attempts to return it to such deflated position upon deflation of the element as will be described in greater detail hereinafter.

In addition to the resilient means 16*b* shown as being in the form of a spring, the sleeve valve means 17 may include additional shock absorbing means referred to generally at 30 and includes a plurality of annular elastomer members 31 separated by relatively nondeformable annular members 32, only one of which is illustrated. Such members are provided in the enlarged annular recess 11*c* formed in the body 12 which recess communicates with bore 16 in body 12 as illustrated.

Valve 17 includes an annular upper flanged end 17*a* which extends into the recess 11*c* as shown and may engage the shock absorbing means upon movement of valve means 17. The shock absorbing means 30 along with the spring 16*b*, will absorb the shock of seating the body 20 of the bore close off means 11 in the valve 17 and will accommodate relative longitudinal movement of the valve 17 relative to body 12 while returning valve 17 to its original position when bore close off means 11 is withdrawn.

Control valve means referred to generally at 35 are carried by the body 12 for controlling communication between various passage ways in the body 12 and the tool components carried thereby as will be described in greater detail.

Resilient means 36 in the form of a spring engage the control valve 35 as illustrated to urge the control valve 35 to the position shown in FIG. 2 of the drawings. In such position, the control valve 35 establishes communication between the well bore annulus referred to by the letter A in FIG. 2 and the interior 14*d* of the reinforced inflatable packer element 14 as well as establishing communication above and below the reinforced packer means 14 through the equalizing passage means referred to generally at 37 when the bore close off means 11 is seated in body 12 as shown in FIG. 3. Such equalizing passage means includes passage means 37*a* extending through the body 12 as shown as well as passage means 37*b* in the seating sleeve 17 which are in communication when the bore close off means is seated in the valve 17 as illustrated in FIG. 3 of the drawings.

As shown in FIG. 2 of the drawings, the seal means 25 and 26*a* prevent communication of the port means 37*a* and 37*b* when the sleeve valve means 17 is in the position shown in FIG. 2 of the drawings. However, equalization of pressure between the interior 14*d* of the reinforced inflatable element 14 and the well bore annulus A when the bore close off tool 11 is not positioned in bore 16 is maintained by reason of port means 41 which communicates with chamber 38 in which the control valve 35 is shown as being positioned as will be explained.

The chamber 38 is formed in the body 12 in any suitable manner and in the form shown in FIGS. 1 thru 9 includes an inner annular wall 38′ and an outer annular wall 38″ radially spaced and extending longitudinally in body 12 to receive the annular control valve 35 therebetween. The control valve 35, in the form illustrated in FIGS. 1 thru 9 of the drawings is adapted to slide on the inner annular surface 38′.

Annular grooves 43 and 44 are formed on the inner annular surface 38′ of chamber 38. Sleeve valve means 17 includes ports 47 and 48 which are sealed off from communication with other ports or passage means in the body 12 as well as the control valve means 35 when the seating valve means 17 is in the position as shown in FIG. 2 of the drawings by reason of the seals 21, 22 and 23, 24 respectively.

The control valve means 35 includes the spaced annular and longitduinally extending recesses 49 and 50 formed on the inner surface thereof as illustrated in the drawings. Spaced seal means 51 and 52 are arranged adjacent one end of the control valve means 35, which seal means are adjacent but spaced from the lowermost end of annular recess 50. Spaced seal means 53 and 54 are positioned on the annular shoulder 55 formed in the annular valve means 35 between the annular recesses 49 and 50 as shown in the drawings. The upper end of control valve means 35 carries suitable seal means 56 as shown.

When the seating sleeve means 17 is in the position illustrated in FIG. 2 of the drawings, the port means 42 in the body 12 communicates at its inner end with the annular groove 57 formed on the outer surface of the seating sleeve means 17. The annular groove 57 extends beyond or across annular seal 22 positioned between the seating sleeve valve means 17 and the body 12 when the valve 17 is in the position shown in FIG. 2 and communicates with the annular groove 58 formed in body 12 adjacent the bore 16 therethrough and adjacent sleeve valve 17 as shown.

By viewing the right hand side of FIG. 2, it can be seen that the annular groove 58 communicates with passage means schematically represented at 59, which, when the control valve 35 is positioned as shown, communicates with the annular recess 50 in such valve 35 so as to conduct well fluid from the well bore annulus A through the port or passage means 42, the annular groove 57, through communicating annular groove 58 and thence through the passage means 59 to the annular recess 50.

When the control valve 35 is in this position as shown in FIG. 2, fluid from the well bore annulus A, is also conducted through port 41 and into the annular chamber 38 and through the annular groove 43 around seal means 56 into annular recess 49 of control valve 35. When the control valve 35 is in the position shown in FIG. 2, recess 49 communicates around seal 53 and with groove 44 which communicates with the passage means 60 in body 12 so that the interior 14*d* of the inflatable reinforced element 14 is thus communicated with the pressure in the well bore annulus A when the valve 35 is in such position. This equalizes the pressure internally and externally of the inflatable element under such conditions.

Accordingly, when the well string S is a drill string and employed in rotary drilling operations the reinforced inflatable element will assume the position illustrated in FIG. 2 of the drawings during rotation of the well string and since the pressure is balanced both exteriorly and interiorly of the inflatable element, rotation of the well string will not cause the inflatable element to tend to expand and thereby engage the well bore wall which might cause damage thereto. Thus, normal drilling operations may occur since pressure in the well bore is equalized internally and externally of the inflatable element.

When the bore close off means 11 is seated and latched in the longitudinal bore 16 in the body 12 of the well string such as a drill string as shown in FIG. 3 of the drawings, its shoulder 18 seats on the shoulder 19 formed in sleeve valve 17.

Referring to FIG. 1, the bore close off means 11 includes the body referred to generally at 20, as previously noted, with a longitudinal bore 100 therein. Positioned within the longitudinal bore 100 is check valve means 101 engaging seat 102 formed in bore 100, which check valve means is urged on to seat 102 by means of spring 103 as shown in the drawings. It will be noted that the check valve 101 is an upwardly closing check valve and closes off fluid flow through the bore 100 from therebeneath.

In addition, shear valve means are provided in the bore 100 as referred to generally at 105, such shear valve means including an annular plug 106 with a shear pin 107 retaining the plug 106 in position in the bore 100. Suitable seal means 108 are positioned between the plug 106 and the bore 100 to inhibit fluid passage therebetween and through bore 100 in either direction when the plug 106 is in the position shown in FIG. 1.

The body 20 also is provided with a shiftable sleeve valve referred to generally at 110 which sleeve valve includes the annular body 111 having a passage 112 therethrough. The passage 112 includes a seat 113 for receiving closure means 114 (see FIG. 8) therein for closing off the bore 112 to enable the valve 110 to shift when well string pressure is applied thereto for purposes that will be described hereinafter. The annular body 111 includes fluid passage means 115 which is normally positioned above seal means 118 as shown in FIG. 1 of the drawings when the body 111 is retained in place by means of the shear pin 118*a* engaged therewith and engaged in body 20 of bore close off means 11. The passage means 115 is adapted to communicate with port 120 in body 20 which is sealed off between the seal means 118 and 119 when the valve 110 is in the position shown in FIG. 1 of the drawings and thereby prevent communication between port means 120 and passage means 115 until pin 118*a* has been sheared, as will be described.

Suitable means are provided to engage or latch the bore close off means 11 in position in the body 12 such latch means being referred to generally at 130 and shown as including pivotally mounted fingers 131 which are pivotally mounted as illustrated at 132. The fingers 131 are mounted in longitudinal slots 133 formed in body 20 and the configuration and pivotal arrangement of fingers 131 on the body 20 is such that the outermost edges project outwardly beyond the radial extend of body 20 as shown in FIG. 1 of the drawings so that as the bore close off means is dropped or pumped down the well string bore 16 such fingers 131 are free to move radially so as not to interfere with downward movement of the bore close off means 11, since they are free to pivot inwardly of the slots 133.

When the body 20 seats as illustrated in FIG. 3 of the drawings, the latches 131 project outwardly into annular recess 11*c*. Any upward movement of the body 20 will engage the upper end of fingers 131 with the upper end 11*d* of the enlarged recess 11*c* in which the shock absorber arrangement 30 and the enlarged annular flange 17*a* of sleeve valve 17 moves. When the fingers 131 are thus positioned, the bore closure means 11 is latched in position in the body 12 to prevent upward movement thereof, and further downward movement is prevented since the shoulder 19 on the bore closure means 11 is seated on seat 18 in valve 17.

An additional shiftable sleeve valve 125 is provided adjacent the upper end of the body 20 which valve includes the annular hollow body 126 telescopically received over the upper end portion 20*b* of the body 20 as shown in FIG. 1, such end portion 20*b* having a reduced diameter 127 forming spaced shoulders 128 and 129 as shown in the drawings. A spring 130 rests on the shoulder 128 and abuts at its other end the annular inwardly extending ledge 132 formed on body 126, which ledge in turn abuts the shoulder 129 as shown in the drawings. The spring 130 tends to urge in annular body 126 upwardly as illustrated in FIG. 1 so as to engage the inwardly extending annular flange 132 against the shoulder 129, but such annular body 126 may be telescoped downwardly over the portion 134 of the body 20 when it is desired to engage and retrieve the bore closure tool 11 from the well string S in a manner as will be described hereinafter.

The body 20 includes annular portion 20*c* which is reduced in diameter between annular seal means 141 and seat 19, as shown, with the seals 142, 143 positioned on body portion 20*f*. Body portion 20*f* is reduced in diameter relative to body portion 20*c* and extends to shoulder 20*e* from which extends reduced annular body portion 20*d* for purposes to be described.

The bore close off means also includes passage means 150, with spring loaded check valve means 151 therein.

With the well bore closure means 11 in the form as illustrated in FIG. 1, it is inserted into the bore 16 of the well string S to which body 12 is connected and initially assumes the relationship in body 20 shown in FIG. 3 of the drawings. It will be noted that the spring 16*b* is collapsed due to the weight of the well bore closure means 11 and the pressure of the fluid in the bore 16 of the well string S, and at this point the interior 14*d* of the inflatable element 14 is communicated to annulus A by passage means 60, annular groove 44, annular recess 49, chamber 38 and port means 41 to equalize the pressure interiorly and exteriorly or the reinforced inflatable packer 14 as previously described.

It will also be noted that the body 20 is provided with suitable annular seals 141, 142 and 143 for sealing off between the bore closure body 20 and the seating valve 17 and for communicating passages in a desired manner as will be described in greater detail.

The bore closure means 11 may be positioned in the bore 16 to close off the bore 16 and in some situations also close off the annulus A of the well bore; however, in some instances it will be used as a means to selectively communicate various portions of the well string S with the well bore annulus A as will be described.

When it is desired to close off the annulus A of the well bore, with the bore close off means 11 seated as shown in FIGS. 3 and 4, the pressure in drill string or well string S may be increased by increasing the pump pressure at the earth's surface so that the pressure in bore 16 is increased whereupon the fluid pressure is communicated through bore 100 in body 20 with passage means 150 and past spring loaded check valve means 151 positioned therein to communicate through the annular space 65 between the sleeve valve 17 and reduced annular portion 20*c* formed on body 20 of the bore close off means 11 seated in the well string as shown in FIG. 3. The pressure from well string S is communicated from space 65 through port means 47 in sleeve valve 17 which is now aligned with groove 58 that communicates to passage 59 in body 12. Passage 59, when the control valve 35 is in the position shown in FIG. 3, communicates to annular recess 50.

Since the drill string or well string pressure from bore 16 is now communicated interiorly of the control valve 35 to recess 50 and since the cross sectional area of the control valve 35 across seal means 53 and 54 is larger than the cross sectional area across the control valve at seal means 51 and 52, the control valve means 35 will be responsive to the drill string or well string pressure in bore 16 above the inflatable element communicated to recess 50, and upon incremental increases of the well string pressure in bore 16 in a predetermined manner, the tool may be operated in a sequential step wise manner to close off the well bore annulus A, to maintain the bore 16 closed, or to open the bore 16 for communication with the well bore annulus A below the inflated element 14, or to communicate the bore 16 with the well bore annulus A above the inflatable element 14 as will be described.

FIG. 4 illustrates the next position of the control valve means 35 and it will be noted that resilient means 36 is shown as being slightly compressed due to the pressure in bore 16 acting through passage means 150 past check valve 151 and in recess 50 to move the control valve in chamber 38 against the spring force 36.

Referring now to FIG. 4, when the well bore closure means 11 is seated in the bore 16 of the body 12 and the packer 14 inflated as shown in FIG. 4, the present invention may be employed so as to seal off the well bore annulus A, or seal off the well string bore 16 and bore 100 in body 20, or accommodate fluid flow from the well string S to the well bore annulus A beneath the inflated element 14, or accommodate fluid flow between the well string S and the well bore annulus A above the inflated element 14.

When the pressure communicated from the bore 16 through passage 150 and communicated through annular space 65 to passage means 58 and annular recess 50 in control valve 35 has caused the control valve 35 to move upward to the position shown in FIG. 4, the seal means 53, 54 moves longitudinally along with the control valve 35 and engages the annular surface 38' on the other side of groove 44, thus closing off communication between chamber 38 and passage 60. This closes off the interior **14*d* of inflatable member 14 from the well bore and opens the recess 50 to passage means 60 through annular groove 44 so that the reinforced packer means 14 may be inflated to seal against the well bore wall represented by the letter W. The spring 103 should retain valve 101 seated, but if it doesn't flow through the bore close off means 11 is prevented at this period, by plug 106**.

It should be noted that before any longitudinal movement of control valve 35 may occur, sufficient drill string bore pressure must be supplied to the recess 50 of the control valve means 35 to overcome the force in resilient means 36. The resilient means 36 may exert any amount of force, and by way of example only, it has been found that when the resilient means 36 exerts a force of approximately 400 pounds per square inch in equivalent hydraulic pressure, a suitable differential between the drill string bore pressure and well bore annulus pressure above the inflated packer means 14 is established to accomplish desired results, as will be noted hereinafter. In addition, it should be noted that well bore pressure above the inflatable element 14 acts on one side of the control valve 35 and well string pressure from bore 16 acts on the other side or inside of the control valve 35. Thus, the control valve 35 is responsive to the pressure in the well string above the bore close off means 11 with reference to the pressure in the well bore annulus A above the inflatable packer 14.

It should be noted that during inflation and deflation of the inflatable packer means 14, it is desirable to equalize above and below such packer in the well bore annulus A and this is accomplished by means of the passage means generally referred to at 37 including the passage means **37*a* formed in body 12 and the passage means 37*b* formed in the sleeve valve 17. Well bore pressure is communicated through port 41 to chamber 38 and then communicates around seal means 56 by means of annular groove 43 which in turn communicates with passage means 37 and then to the interior of bore 16 adjacent reduced diameter portion 20*a* as shown in FIGS. 3 and 4** of the drawings.

After the inflatable member 14 has been seated against the well bore wall W to seal off the well bore annulus A, desired operations may be carried out.

Figure 5:
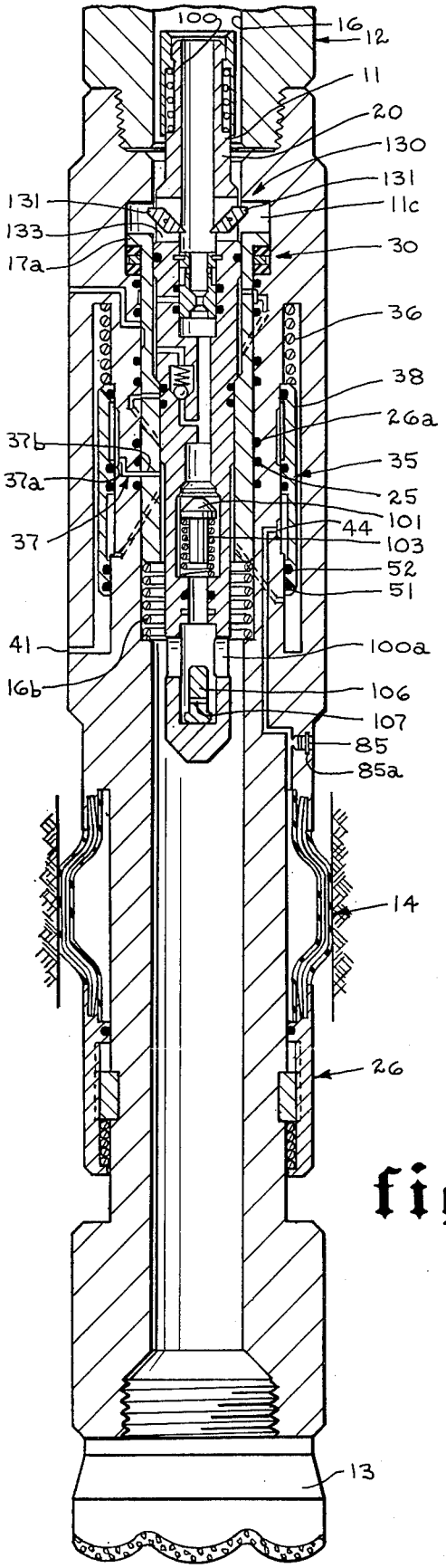
FIG. 5 is a sectional view similar to FIG. 4 but shows the well bore close off means actuated for communicating the well string above the inflated element with the well bore below the inflated packer means.

For example, in FIG. 5 it will be noted that the pressure in the bore 16 has been increased sufficiently so as to cause the shear pin 107 holding the plug 106 in place to shear thereby permitting the annulus 100 of the body 20 to communicate through openings **100*a* with the well bore annulus A beneath the inflated element or member 14. Thus desired operations may be carried out, or if it is desired to reseal the annulus 100 after the plug 106 has been removed, slight release of pressure in bore 16 will permit valve 101 to be reseated by reason of spring 103** acting thereon.

Figure 6:
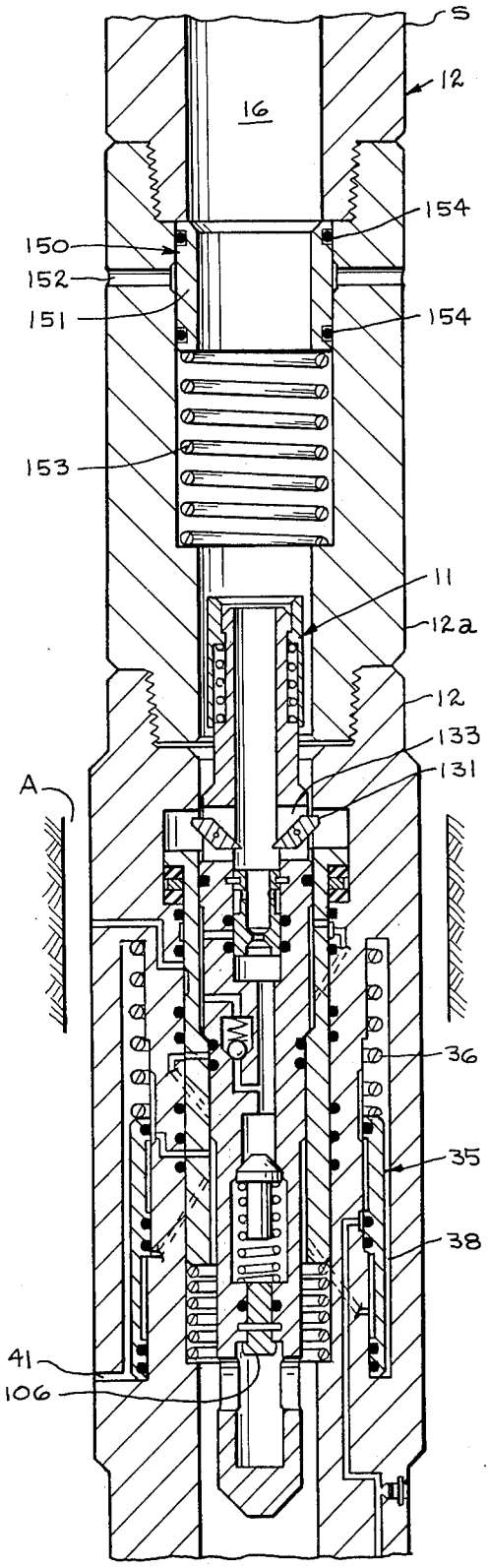
FIG. 6 is a sectional view similar to FIG. 4 and illustrates port means in the tool which is normally closed off by shiftable valve means but which can be actuated for communicating the drill string and the well bore above the inflated packer means.

FIG. 6 shows the body 12 as having an extension **12*a* in which is received a shiftable valve 150, such shiftable valve including the annular body 151 which closes off port means 152 through body 12 by reason of its positioning due to spring 153 which retains the annular body 151 normally in the position shown in FIG. 6**.

The body 151 includes suitable spaced seal means 154 for sealing between the body 12 and the annular bore 16 to inhibit fluid leakage thereby between bore 16 and ports 52.

Figure 7:
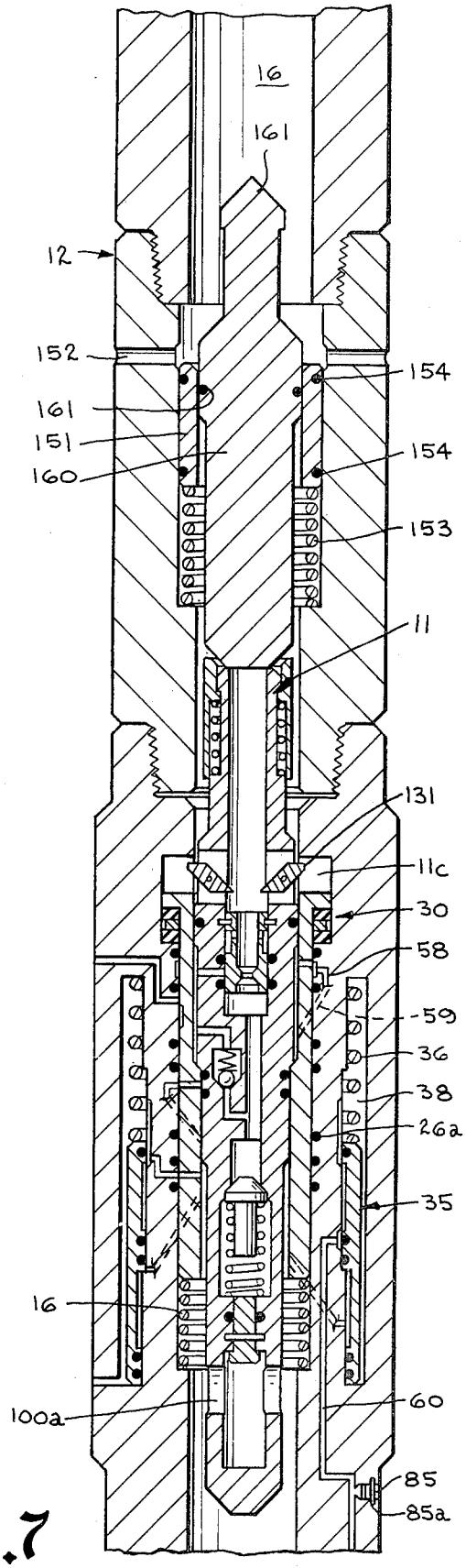
FIG. 7 is a sectional view similar to FIG. 6 and shows plunger means seated in the shiftable valve means of FIG. 6 to open the port means whereby fluid from a well string may be circulated to the well bore annulus above the inflatable closure means on the tool.

If, for any reason, it is desired to circulate well fluids between the well string S and well bore annulus A after the member 14 has been expanded to seal with the well bore wall W, a suitable go-devil or plug 160 may be dropped through bore 16 as shown in FIG. 7 so as to rest on top of the bore close off means 11 as illustrated in FIG. 7. The go-devil 160 includes suitable seal means 161 so that when pressure is applied thereto, the annular body 151 will be forced downwardly in the bore 16 against the tension of spring 153 thereby opening ports 152 for circulation between the bore 16 and the well bore annulus as may be desired.

After the go-devil 160 has performed its function, it may be engaged by any suitable grappling tool engaging the upper end 161 thereof in a manner well known in the art so as to permit the plunger 160 to be withdrawn from the bore 16. When the plunger 160 is withdrawn, the valve 151 will reassume the position shown in FIG. 6 of the drawings to close off port means 152.

Figure 8:
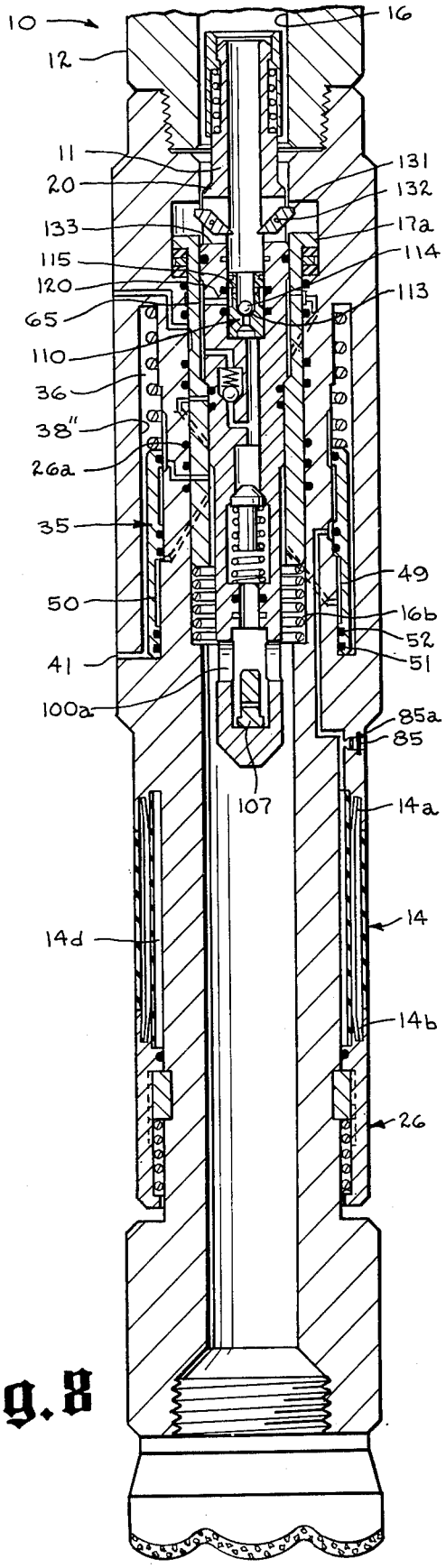
FIG. 8 is a sectional view similar to FIG. 5 but illustrates shiftable valve means in the bore close off means shifted to enable the inflatable packer element to deflate and to establish communication with the well bore and the interior of the inflatable element.

When it is desired to deflate the inflatable element 14 so as to continue normal well operations, the closure referred to at 114 in FIG. 8 is dropped or pumped through the bore 16 so as to engage on seat 113 in the shiftable valve 110. When this occurs, increase of fluid pressure in the well bore 16 will shear the pin **118*a* thus moving the shiftable sleeve valve downwardly in the bore 100 as illustrated in FIG. 8 of the drawings. When this occurs the passage means 115 communicates with port 120 which in turn communicates with annular space 65. Since annular space 65 communicates with the annular recess 50 in control valve 35 by passage means 59, release of well string pressure in the bore 16 will cause the control valve 35 to be moved towards its original position as illustrated in FIG. 3**.

In moving towards such position, it first moves through the relative position shown in FIG. 4 where equalization is established between the annulus A and the interior 16 of the well string S beneath the closure tool and beneath the inflatable element 14 and further decrease in pressure in the bore 16 of the well string S enables the control valve 35 to reassume the position shown in FIG. 3 of the drawings. The pressure differential obtained by the spring 36 causes the control valve 35 to assume proper positioning to assure deflation of the inflatable element 14.

At this point, the pressure in the annulus A above and below the inflatable element 14 is equalized as well as fluid pressure on the interior **14*d* of the inflatable element and the annulus A to assure proper deflation of the inflatable member 14**.

Figure 9:
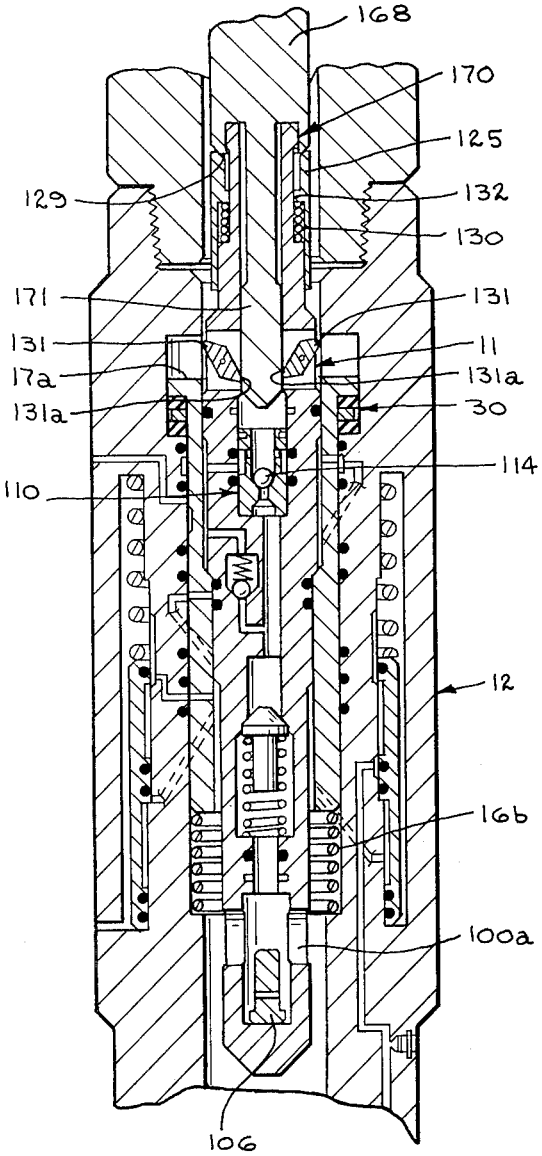
FIG. 9 is a partial sectional view illustrating an arrangement for actuating the latch means to release the bore close off means from seated and latched position within the well string for removal from the well string.

Thereafter, the well bore closure means may be engaged and removed from the well bore. To accomplish this, a suitable retrieving tool having a suitable collet arrangement well known in the art and referred to generally at 170 in FIG. 9 is lowered downwardly so as to engage or abut the upper end of shiftable valve or member 125. When it engages shiftable member 125, spring 130 is collapsed as shown in FIG. 9 and annular flange 132 moves away from shoulder 129 thus exposing such shoulder so that it may be engaged by the grapple or collet arrangement 170 as shown in FIG. 9.

The retrieving tool 168 also includes suitable plunger means 171 which moves through the bore 100 of the bore closure means 11 and engages the inner lower end 131*a* of the latches or fingers 131 to pivot them inwardly so that when the retrieving tool 128 is then moved upwardly in well string S, such latches 131 clear the shoulder or end 11*d* of recess 11*c* and thus enables the bore closure means 11 to be moved upwardly out of the well string. It can be appreciated that the retrieving tool 168 may be lowered by any suitable means well known in the art such as a cable or the like to engage the well bore closure means.

Figure 10:
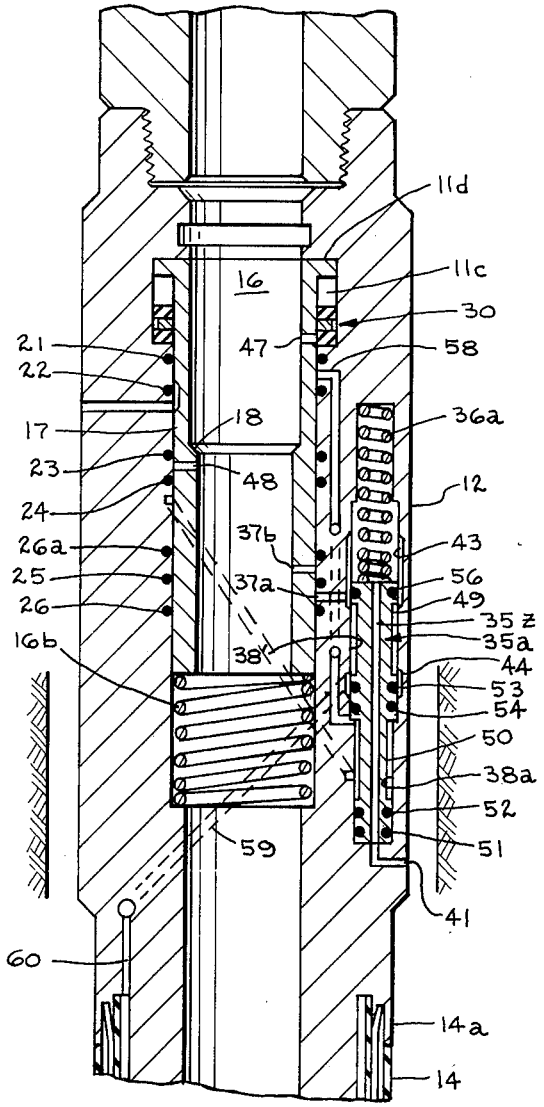
FIG. 10 is a partial sectional view illustrating an alternate form of control valve means.

FIG. 10 shows an alternate arrangement of the control valve wherein like numbers refer to like parts. In FIG. 10, the control valve is represented generally at 35*a* and is shown in the form of a spool valve which is arranged in cylindrical chamber 38*a* of body 12. The function and operation of this valve is the same as the form shown in FIGS. 1–9. Well bore pressure acting through port 41 is communicated through passage 35*z*, in the body of valve 35*a*, chamber 38*a*, through annular groove 43 in body 12 and around seal 56 to space or recess 49 and then aroung seal 53 adjacent groove 44 to passage 60 and the interior of packer 14 when the valve 35*a* is in the position shown in FIG. 10 to equalize pressure internally and externally of the packer 14.

When the bore close off means is seated on 17 so that 47 and 58 communicate with bore 16, well string pressure is communicated through 58 to act in recess 50 and against seals 53, 54. The cross sectional relationship of the valve 35*a* at seals 53, 54 and 51, 52 is similar to that previously described. An increase in pressure in recess 50 will force valve 35*a* upwardly in chamber 38*a* against spring 36*a* so that seal 53 engages surface 38 above groove 44 to first close off communication between the interior of the packer 14 and well bore annulus A. Continued pressure increase in the well string S moves control valve 35*a* upwardly until seal 54 is over groove 44 whereupon the well string pressure may be communicated to passage 59, passage 60 and packer 14 for inflation thereof.

Deflation of packer 14 and other functions of control valve 35*a* is similar to that described with regard to FIGS. 1–9. Other like numbered parts also function in a manner to that described with regard to FIGS. 1–9.

A shear safety plug 85 is positioned in body 12 by shear pin 85*a* and communicates with passage means 60, so that if desired or necessary, the pressure in passage 60 can be increased to shear pin 85*a* and thus release the pressure in reinforced inflatable packer means 14.

The foregoing disclosure and description of the invention are illustrative and explanatory thereof, and various changes in the size, shape, and materials as well as in the details of the illustrated construction may be made without departing from the spirit of the invention.

What is claimed is:

1. Apparatus for controlling wells during drilling operations comprising:

a. a body for connection in a well string, said body having a longitudinal bore therethrough;

b. reinforced inflatable packer means carried by said body for inflation to seal off the well bore;

c. bore close off means movable through the well string for seating in said body to close off the bore therethrough;

d. control valve means carried on said body and having means responsive to well bore pressure and pressure in the drill string whereby said control valve is movable in one direction in response to increasing pressure differential between the drill string above said bore close off means when seated and the well bore above said packer means to communicate said packer means with a drill string for inflation of said packer means and movable in the opposite direction in response to decreasing pressure differential between the drill string above said bore close off means when seated and the well bore above said inflated packer means to communicate said packer means with the well bore for deflation therefor; and e. latch means for latching said bore close off means in position in the well string.

2. The invention of claim 1 including seating valve means carried by said body for said bore close off means normally closing off communication between the body bore and said control valve means.

3. The invention of claim 1 wherein said bore close off means includes:

a. an elongated body having a longitudinal bore;

b. spring loaded check valve means for closing off flow through the bore in one direction; and c. therebeing passage means in said bore close off means for communicating well string pressure with said control valve to position said control valve for inflation and deflation of said packer when said bore close off means is latched in position in the well string.

4. The invention of claim 1 including seal means between said bore close off means and said body means for sealing between said body and said bore close off means when said bore close off means is latched in position in the well string.

5. The invention of claim 3 including releasable plug means in the bore of said bore close off means which is removable when the pressure in well string above said bore close off means exceeds a predetermined amount to establish communication through the well string below said reinforced inflatable packer means.

6. The invention of claim 1 wherein the well string includes port means for communicating the well string with the well bore, shiftable valve means normally closing off the port means and plunger means for sealing with said shiftable valve means so that when well string pressure is increased, said shiftable valve means is movable to uncover the port means for circulation between the well string and well bore above the inflatable packer means.

7. The invention of claim 3 including:

a. a shoulder adjacent one end of said elongated body;

b. spring loaded sleeve means abutting said shoulder means and surrounding said shoulder; and c. plunger means movable through the well string for actuating said latch means to release said bore close off means from the well string, said plunger means also moving said sleeve means to expose said shoulder for engagement with said plunger means whereby said bore close off means may be withdrawn from the well string.

8. The invention of claim 3 including:

a. port means in said bore close off means for communicating with said seating valve means;

b. shiftable valve means normally closing off said port means, said shiftable valve means initially having a flow path therethrough communicating with the bore of said bore close off means and said shiftable valve means adapted to be shifted when the flow path is closed off to thereby open said port means and communicate the interior of said reinforced inflatable packer means with the well string whereby said reinforced inflatable packer means may deflate upon decreasing the pressure in the well string.

9. The invention of claim 1 including means associated with said control valve to communicate said reinforced inflatable packer means with the well bore for deflation thereof when the pressure in the well string above said seated bore close off means exceeds the pressure in the well bore above said reinforced inflatable packer means by a predetermined amount.

10. The invention of claim 1 including equalizing passage means in said body for equalizing the pressure internally of said reinforced inflatable packer means with the pressure in the well bore above and below said packer means to aid in maintaining said reinforced inflatable packer means deflated during drilling operations.

11. The invention of claim 1 including shear valve means in said body which will release the inflating pressure from said inflatable packer means when the pressure therein exceeds a predetermined amount.

12. The invention of claim 2 including resilient means supporting said seating valve means to function as a shock absorber means.

13. The invention of claim 3 including valve means normally closing off the passage means in said bore close off means, but movable to open the passage means when the pressure in the well string exceeds a predetermined amount.

14. The invention of claim 1 including:

a. an annular recess in said body for receiving said latch means; and b. said latch means comprising pivotally mounted members mounted on said bore close off means and engagable in the annular recess to aid in retaining said bore close off means in said body.

15. The invention of claim 4 wherein said seal means is mounted on said bore close off means and engages said seating valve means carried by said body.

16. The invention of claim 6 including seal means between said shiftable valve means and the well string to inhibit fluid flow therebetween.

17. The invention of claim 16 wherein said seal means is mounted on said shiftable valve means.

18. The invention of claim 14 including:

a. a shoulder adjacent one end of said elongated body;

b. spring loaded sleeve means surrounding said shoulder;

c. plunger means movable through the well string for actuating said latch means to release said bore close off means from the well string, said plunger means also moving said spring loaded sleeve means to expose said shoulder for engagement with said plunger means whereby said bore close off means may be withdrawn from the well string; and d. said plunger means including means for engaging said latch means to retract them from the annular recess.

19. The invention of claim 2 including passage means in said seating valve means, bore close off means, body and control valve means for communicating said reinforced inflatable packer means with the well string as the pressure in the well string above said seated bore close off means with reference to the pressure in the well bore above said reinforced inflatable packer means in increased for inflation of said reinforced inflatable packer means to seal off the well bore annulus.

20. The invention of claim 19 wherein said passage means in said seating valve, bore close off means, body and control valve means communicates said reinforced inflatable packer means to the well string above and below said reinforced inflatable packer means as the pressure in the well string above said seated bore close off means with reference to the pressure in the well bore above said reinforced inflatable packer means is decreased for deflation of said reinforced inflatable packer means.

21. The invention of claim 3 including:

a shoulder adjacent one end of said elongated body;

b. spring loaded sleeve means surrounding said shoulder;

c. plunger means movable through the well string for actuating said latch means to release said bore close off means from the well string, said plunger means also moving said spring loaded sleeve means to expose said shoulder for engagement with said plunger means whereby said bore close off means may be withdrawn from the well string; and d. said plunger means including means for engaging said latch means to retract them from the annular recess.

22. The invention of claim 21 wherein said means for engaging said latch means includes additional plunger means for engaging within the longitudinal bore of said elongated body to engage and pivot said latch means toward said elongated body.

23. A well bore closure tool for use in a well string having a reinforced inflatable element thereon, control valve means for controlling communication between the well string and reinforced inflatable packer means and a resiliently supported seating sleeve valve means in the well string for receiving the well bore closure tool, the combination including:

a. an elongated body having a longitudinal bore;

b. spring loaded check valve means for closing off flow through the longitudinal bore in one direction;

c. therebeing passage means in said body for communicating the bore in said body with the control valve in the well string; and d. spring loaded check valve means normally closing off the passage means, but operable to open the passage when a predetermined pressure exists in the longitudinal bore for communicating well string pressure to act on the control valve and position it to communicate the well string for inflation of the reinforced inflatable element.

24. The invention of claim 23 including seating means on said elongated body for seating the well bore closure tool in the well string.

25. The invention of claim 24 including seal means on said elongated body for sealing between the well bore closure tool and the well string when the well bore closure tool is seated therein.

26. The invention of claim 23 including:

a. shoulder adjacent one end of said elongated body;

b. spring loaded sleeve means surrounding said shoulder; and c. plunger means movable through the well string for actuating said latch means to release the bore close off means from the well string, said plunger means also moving said sleeve means to expose said shoulder for engagement with said plunger means whereby the well bore close off means may be withdrawn from the well string.

27. The invention of claim 26 wherein said means for engaging said latch means includes additional plunger means for engaging within the longitudinal bore of said elongated body to engage and pivot said latch means toward said elongated body.

28. The invention of claim 23 including:

a. port means in said elongated body for communicating with the seating valve means;

b. shiftable valve means normally closing off said port means, said shiftable valve means initially having a flow path therethrough communicating with the longitudinal bore of the bore close off means and said shiftable valve means adapted to be shifted when the flow path is closed off to thereby open said port means and communicate the interior of the reinforced inflatable packer means with the well string whereby the reinforced inflatable packer means may deflate upon decreasing the pressure in the well string.

29. The invention of claim 23 including valve means normally closing off the passage means in said body but movable to open the passage means when the pressure in the well string exceeds a predetermined amount.

30. The invention of claim 23 including releasable plug means in the longitudinal bore of said body which is removable when the pressure in well string above the bore close off means exceeds a predetermined amount to establish communication through the well string below the reinforced inflatable packer means.

31. The invention of claim 23 including latch means for engaging with the well string to latch the well bore close off means in the well string.

* * * * *

UNITED STATES PATENT OFFICE

CERTIFICATE OF CORRECTION

Patent No. 3,941,190 Dated March 2, 1976

Inventor(s) George E. Conover, deceased

It is certified that error appears in the above-identified patent and that said Letters Patent are hereby corrected as shown below:

Abstract, Col. 2, line 19, after "may" insert --be--

Col. 7, line 15, "extend" should be --extent--

Col. 7, line 43, "in" should be --the--

Signed and Sealed this

*eleventh* Day of *May 1976*

[SEAL]

*Attest:*

RUTH C. MASON
*Attesting Officer*

C. MARSHALL DANN
*Commissioner of Patents and Trademarks*